US006591558B1

(12) United States Patent
De Zen

(10) Patent No.: US 6,591,558 B1
(45) Date of Patent: Jul. 15, 2003

(54) PREFABRICATED PLASTIC SHED AND COMPONENTS THEREFOR

(75) Inventor: Vic De Zen, Woodbridge (CA)

(73) Assignee: Royal Group Technologies Limited, Woodbridge ( * ) Notice: Subject to any disclaimer, the term of this patent is extended or adjusted under 35 U.S.C. 154(b) by 0 days.

(21) Appl. No.: 09/376,284

(22) Filed: Aug. 18, 1999

(30) Foreign Application Priority Data

Aug. 20, 1998 (CA) ..... 2245624

(51) Int. Cl.[7] ..... E04B 7/04
(52) U.S. Cl. ..... 52/91.3; 52/91.1; 52/729.2
(58) Field of Search ..... 52/57, 91.1, 91.3, 52/284, 282.1, 282.3, 738.1, 737.4, 736.3, 729.2, 731.1

(56) References Cited

U.S. PATENT DOCUMENTS 3,199,258 A * 8/1965 Jentoft et al. ..... 52/222
3,436,881 A * 4/1969 Schlecht ..... 52/91.3
4,081,941 A * 4/1978 Van Ausdall ..... 52/726.2
4,955,173 A * 9/1990 Czechowski ..... 52/737.4
5,511,355 A * 4/1996 Dingler ..... 52/729.5
5,706,620 A 1/1998 De Zen
6,000,176 A * 12/1999 Lancaster ..... 52/198
6,122,886 A * 9/2000 Richardson ..... 52/734.2

FOREIGN PATENT DOCUMENTS

| | | |
|---|---|---|
| DE | 2 235 322 A1 | 1/1974 |
| EP | 0 320 745 A1 | 6/1989 |
| WO | WO 93/24714 A1 | 12/1993 |
| WO | WO 94/21867 A1 | 9/1994 |
| WO | WO 95/33106 A1 | 12/1995 |
| WO | WO 97/26459 A1 | 7/1997 |

* cited by examiner

*Primary Examiner*—Gregory J. Strimbu

(57) ABSTRACT

A prefabricated plastic shed having a roof formed with plastic panels sloping upwardly to a central ridge having their upper ends supported by a ridge beam assembly comprising a metal beam and a plastic sleeve member sleeved on, supported by and encasing the metal beam. The plastic sleeve member including panel supporting shelves for supporting the upper ends of the roof panels.

14 Claims, 9 Drawing Sheets

44
45
45
46
46
47
47
26
43
42
26
32
33
31
31
30
34
29

26
26
35
37
42
43
32
33
13a
29
34

FIG.10.
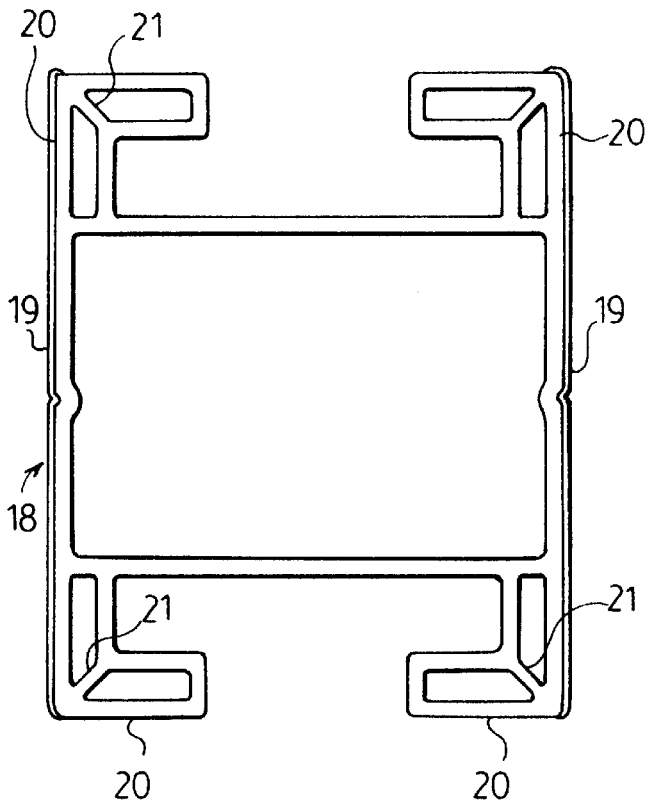
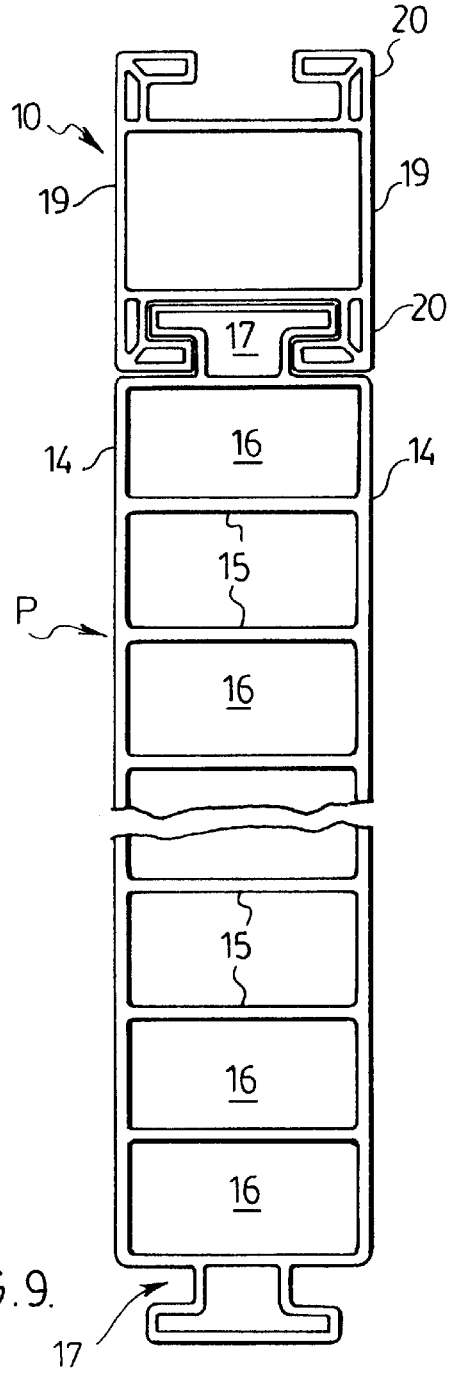
FIG.9.

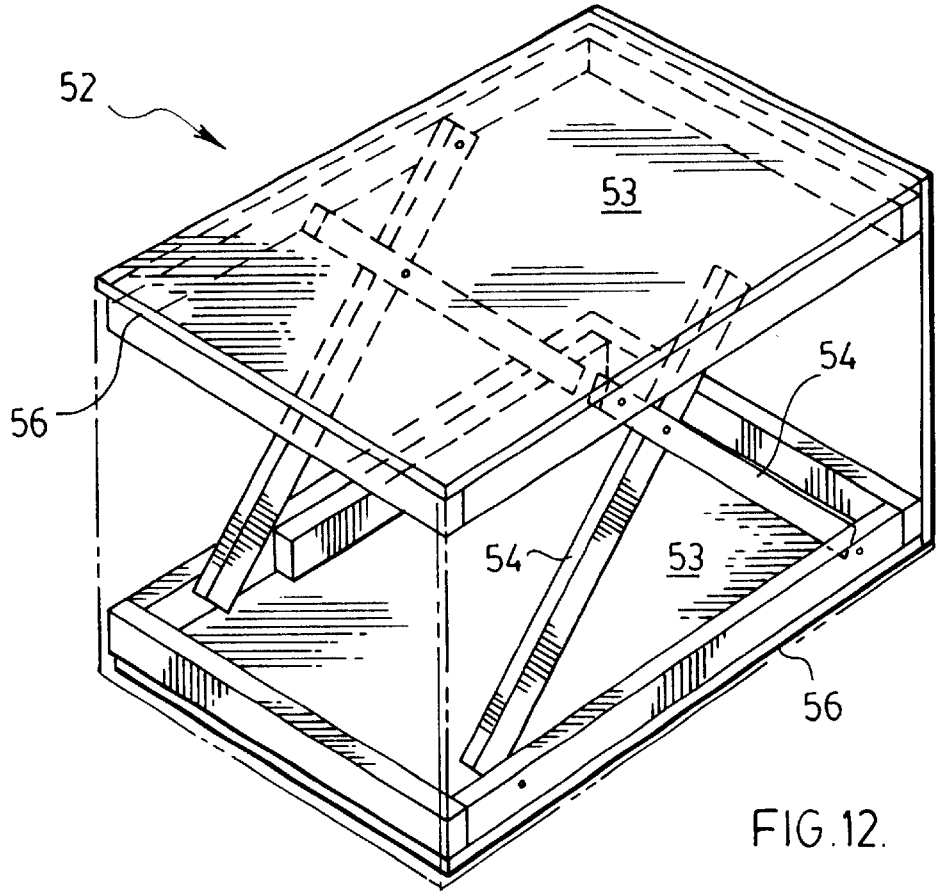
FIG.12.
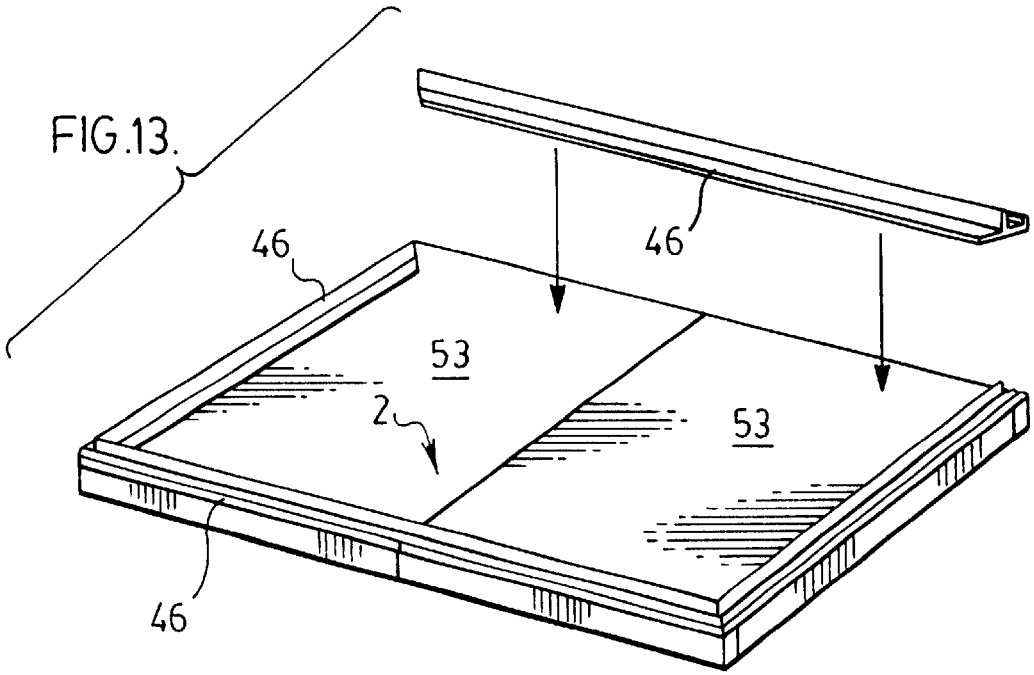

PREFABRICATED PLASTIC SHED AND COMPONENTS THEREFOR

FIELD OF THE INVENTION

This invention relates to prefabricated small area sheds such as those used, for example, for storing garden tools and equipment in backyards.

BACKGROUND OF THE INVENTION

Various prefabricated sheds off the type with which the present invention is concerned are presently available usually formed of wood or steel components. These sheds which are quite expensive are sold as kits to the ultimate consumer who assemble them in their backyards or other locations.

In order to erect these sheds, a base must be provided on which the shed is to sit. Such bases may be concrete pads or wood platforms the provision of which is normally the responsibility of the customer who also must provide proper anchorage of the shed to the base.

Such prior art sheds when erected are often very flimsy with the metal sheds subject to rattling in the wind. Further roof loading is limited and the roofs are subject to buckling or collapse under heavy snow loads.

Further such sheds are subject to weathering with the metal sheds subject to rusting and they require significant maintenance to keep them from deteriorating and becoming an eye sore.

SUMMARY OF THE INVENTION

The present invention resides in providing a very economical prefabricated shed which overcomes the problems of the present small area sheds, the shed being formed of plastic components to be sold as a kit, the components being easily assembled into a permanent structurally sound maintenance free attractive structure.

In another aspect the present invention involves the packaging of the fabricated shed components in a packing case or crate that serves as the shed base and providing a very simple novel arrangement for anchoring the shed to the base.

More particularly, according to one aspect of the invention, the shed is a rectangular structure having side walls, gabled end walls which slope upwardly to a central ridge and a roof, all formed of connected hollow plastic panels with the roof sloping upwardly from the side walls towards a central ridge, the roof panels being supported at the lower ends on the side walls and at their upper ends by a ridge beam assembly. This ridge beam assembly comprises a metal beam spanning between and supported by the end walls, the beam being encased in a longitudinal plastic sleeve extending between the end walls, the sleeve being formed with an integral longitudinally extending downwardly sloping braced shelve at each side thereof for supporting the upper ends of the roof panels and a ridge flashing overlying the ridge beam assembly and the upper ends of the roof panels.

According to the preferred embodiment of the invention, the ridge beam sleeve is formed with a upwardly facing channel presenting latch hooks at the upper edges thereof and the ridge flashing comprises a pair of wings sloping downwardly from an apex at an angle corresponding to the roof pitch and being provided with downwardly projecting legs adapted to telescopically engage with the sleeve channel, the legs having latch hooks at their lower ends to snap interlock with the sleeve channel latch hooks.

Again, according to the preferred form of the invention, the wall and roof panels are formed at each longitudinal edge thereof with a hollow locking T and the means connecting the panels comprises a rectangular hollow extrusion having hollow right angularly inturned locking fingers to tightly encompass and grasp the locking T's of adjoining panels.

According to another aspect of the invention, the components of the shed kit include aluminum channel members for securement to the base for the shed provided by the packing case. These channel members have an integral bottom nailing fin for fastening them to the base around its perimeter with the channel members having a width to receive the lower ends of the wall panels for securement thereto. When mounted, these channels present an inner channel wall higher than the outer channel wall to provide run off of any water accumulating in the channel to the outside of the shed.

In another aspect of the invention, the hollow shed extrusions are provided with small flexible plastic inserts at the points where fasteners are employed to permanently secure the components in assembled relation.

BRIEF DESCRIPTION OF THE DRAWINGS

These and other features will become apparent from the detailed description taken in connection with the accompanying drawings in which

FIG. 9 is a plan view of one of the extruded plastic panels used for the shed walls and roof showing the profile of these panels and further showing the panel engaged by an extruded connector having hollow locking fingers in accordance with the invention for connecting panels in aligned relation.

FIG. 10 is an enlarged view of the connector as shown in FIG. 9.

FIG. 12 is a perspective view of the packing case or crate in which the components making up the prefabricated shed are packaged and showing the top and bottom platforms of the case which are to form the base of the shed erected from the packaged components.

FIG. 13 is a perspective view of the assembled packing case platforms to form the shed base and showing the shed anchoring channels being assembled on the base ready to receive the shed walls comprising the shed wall panels and their connectors.

DETAILED DESCRIPTION ACCORDING TO THE PREFERRED EMBODIMENTS OF THE PRESENT INVENTION

Figure 1:
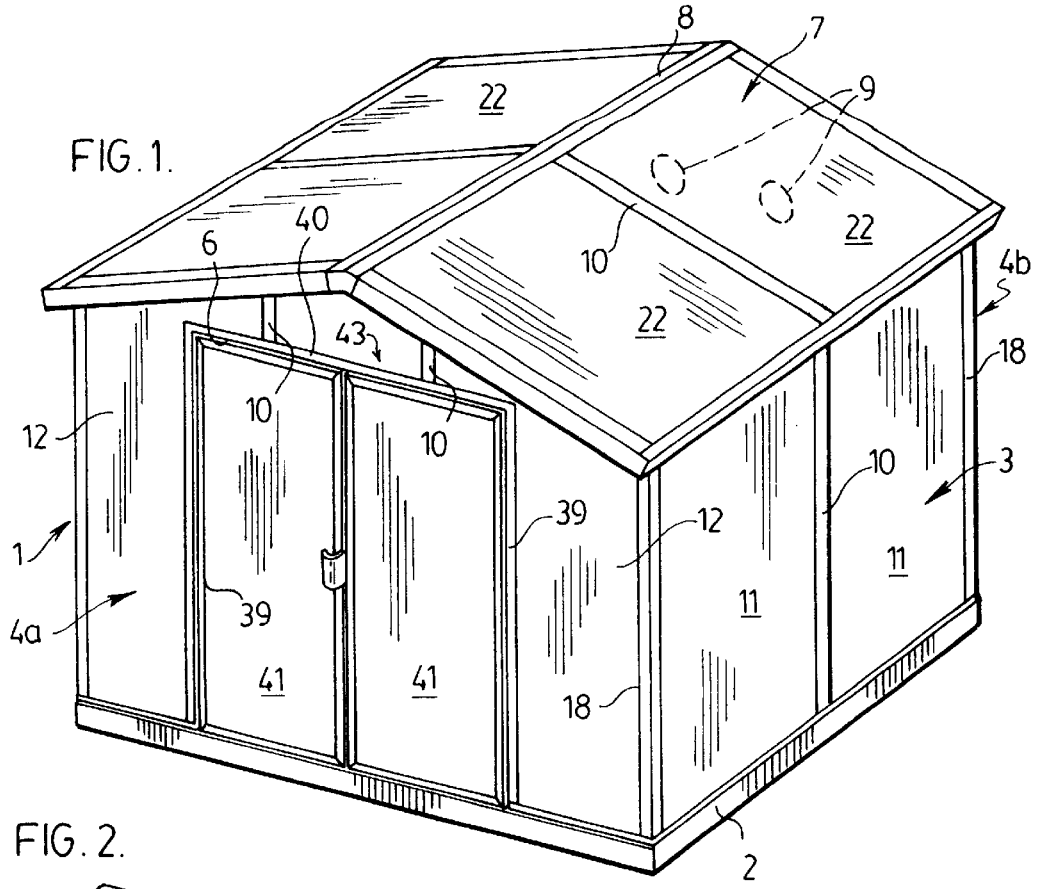
FIG. 1 is a perspective view of an assembled shed formed of prefabricated plastic components in accordance with the invention.

With reference to FIG. 1, the shed generally designated at 1 and constructed of assembled prefabricated components in accordance with the invention is shown mounted on a base or platform 2 formed from the packing case in which the components were shipped as hereinafter more fully explained.

The shed 1 FIG. 1 has a rectangular cross section having side walls 3 and end walls, that is front and rear walls 4*a* and 4*b* respectively, with the front wall 4*a* being cut away to provide a door opening 5 in which doors 6 are hingedly mounted. The roof 7 of the shed slopes upwardly from the side walls 3 to a central ridge 8. Suitable vents 9 may be provided in one or more walls of the shed.

A typical shed, as an example, would have side walls of some six feet and end walls of some eight feet measured in a horizontal direction and the height of the shed from the base 2 to the ridge 8 would be of the order of some six feet.

All of the walls 3 and 4*a* and 4*b* and the roof 7 are formed from hollow extruded thermoplastic panels having, before being cut where required, the profile illustrated by the panel P shown in FIG. 9. The Figure also shows the panel P engaged by a connector 10.

In particular, as shown in FIG. 1, the side walls are formed from two panels 11 having the profile of panel P joined by a connector 10 with these panels 11 and connector 10 being squared off at the top to provide a level top to the side walls.

Also as shown in FIG. 1 the front wall 4*a* is shown formed of three panels joined by connectors 10. These panels comprise a pair of panels 12 cut to provide sloping top surfaces corresponding to the pitch of the shed roof and also cut away to provide the door opening, and a short central panel 13 having its upper end cut to slope upwardly to a central peak.

It will be understood that the rear wall 4*b* is formed of connected corresponding panels 12*a* (see FIG. 3) and 13*a* (see FIG. 8) except that the panels 12*a* are not cut out for a door opening and the panel 13*a* will extend the full height of the shed.

As illustrated by the panel profile in FIG. 9, each of the panels 11, 12, 12*a*, 13 and 13*a* is a hollow extrusion having parallel spaced walls 14 connected by webs 15 to provide a plurality of longitudinal chambers or compartments 16 running the length of the panel. The side edges of the panel terminate in a hollow T formation 17 with the width of the head of the T being less than the spacing of the side walls 14 for engagement with the connectors 10 shown in FIGS. 9 and 10 for connecting the panels in aligned relation and the connector 18 shown in FIG. 11 for connecting the side and end panels in right angular relation at the shed corners.

More particularly, the connector 10 is a square extrusion having side walls 19 from which extend right angular inturned fingers 20 which are hollow and reinforced by the internal diagonal webs 21 at the point the fingers turn inwardly.

These hollow fingers 20 provide an extremely strong solid interlock with the hollow panel T-shaped connector 17 providing a very tight fit between the interlocked members.

The connectors 10 can readily be assembled with the panels by sliding one relative to the other with the hollow fingers having sufficient resiliency to be introduced under the heads of the T connectors 17 while recovering into a tight seal when assembled with the panel.

Figure 11:
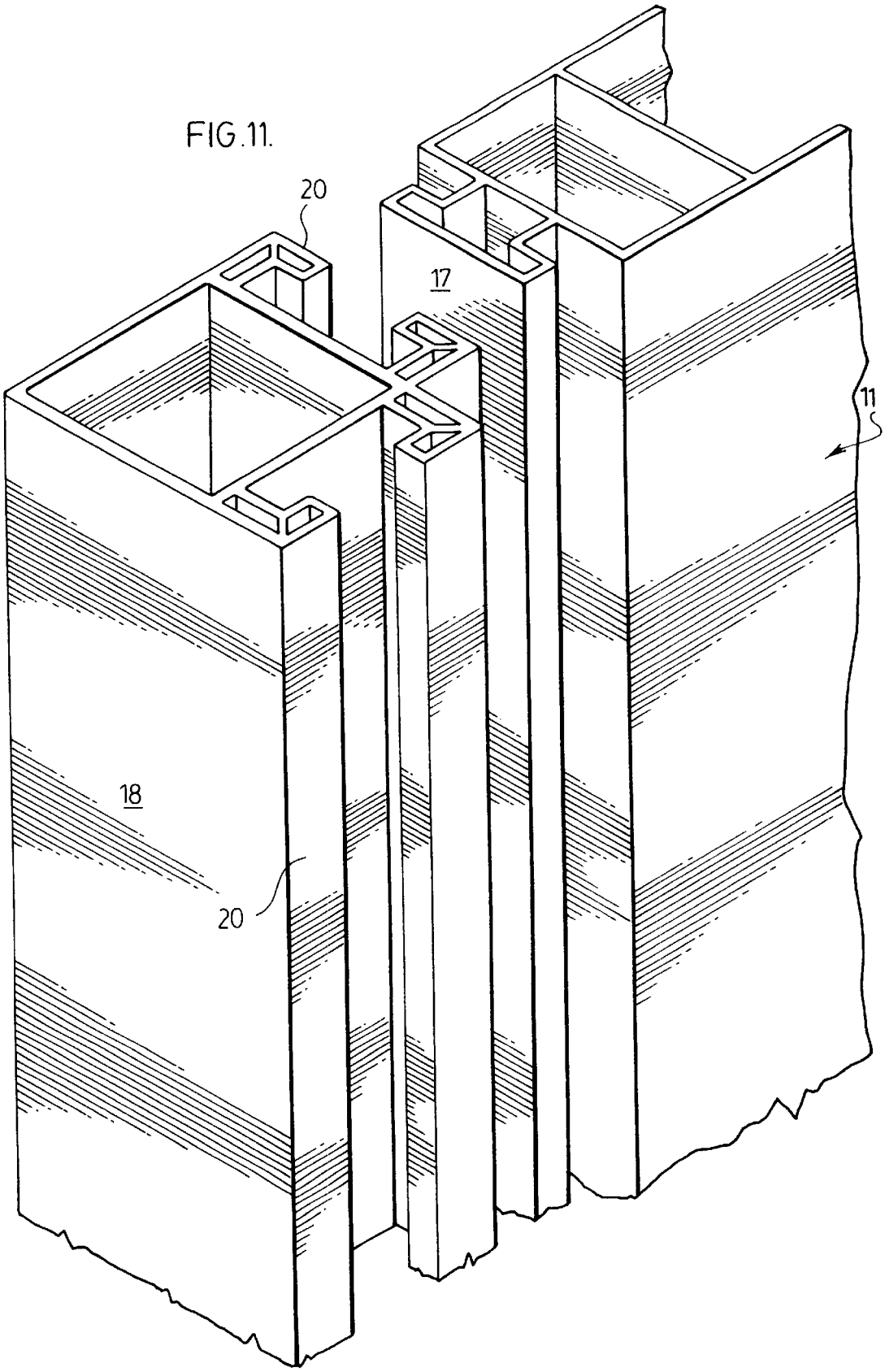
FIG. 11 is a broken away enlarged perspective view showing a corner connector having hollow interlocking fingers and a wall panel having a hollow T-shaped end adapted to be secured within the connector fingers.

The corner connector 18 shown in FIG. 11 is provided with fingers identical to those of connector 10 and again identified by the numeral 20. However, in the case of the corner connector 18, these fingers are on adjacent sides of the connector.

The various panels and the connectors 10 and 18 are preferably extruded from polyvinyl chloride including suitable stiffening agents and are coextruded to provide a thin protective skin or cap stock covering the outer surfaces thereof which are exposed when the shed is assembled.

As shown in FIG. 1, each side of the roof is formed from two roof panels 22 which are identical to the side wall panels 12 and are joined by a connector 10.

Figure 3:
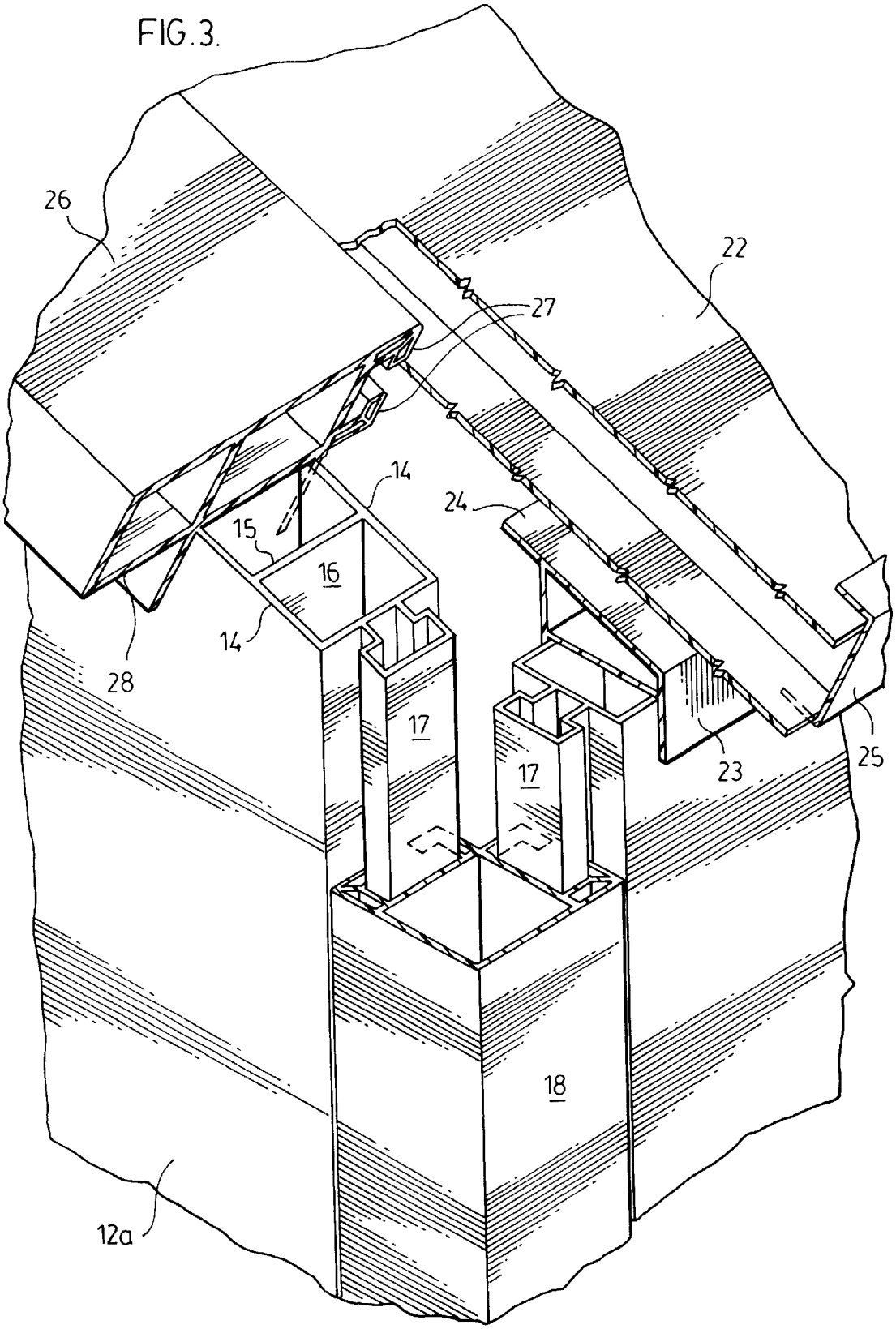
FIG. 3 is a broken away perspective view of an upper rear corner of the shed of FIG. 1 illustrating a corner connector connecting a side and a rear wall panel and showing how a roof panel is supported at its lower end on the side wall cap member and showing how the upper end of an end wall is closed by an end wall cap member.

As illustrated in FIG. 3, the lower ends of the roof panels 22 are supported from the upper end of the side walls on a side wall cap 23 fitting down over the top of the side wall and presenting a sloping surface 24 angled to the pitch of the roof. An end cap 25 closes the open end of the roof panels.

As further illustrated in FIG. 3, the roof portion formed by the roof panels 22 is closed at the end or rear wall 4*a* by an end wall cap 26 formed to seat down on top of the rear wall panel 12*a*. This end wall cap 26 has locking fingers 27 corresponding to the locking fingers of the connectors 10 and 18 to interlock with the roof wall panel edge T formations 17 and with an extended section 28 to project beyond the rear wall 4*a* to provide a roof overhang.

Figure 7:
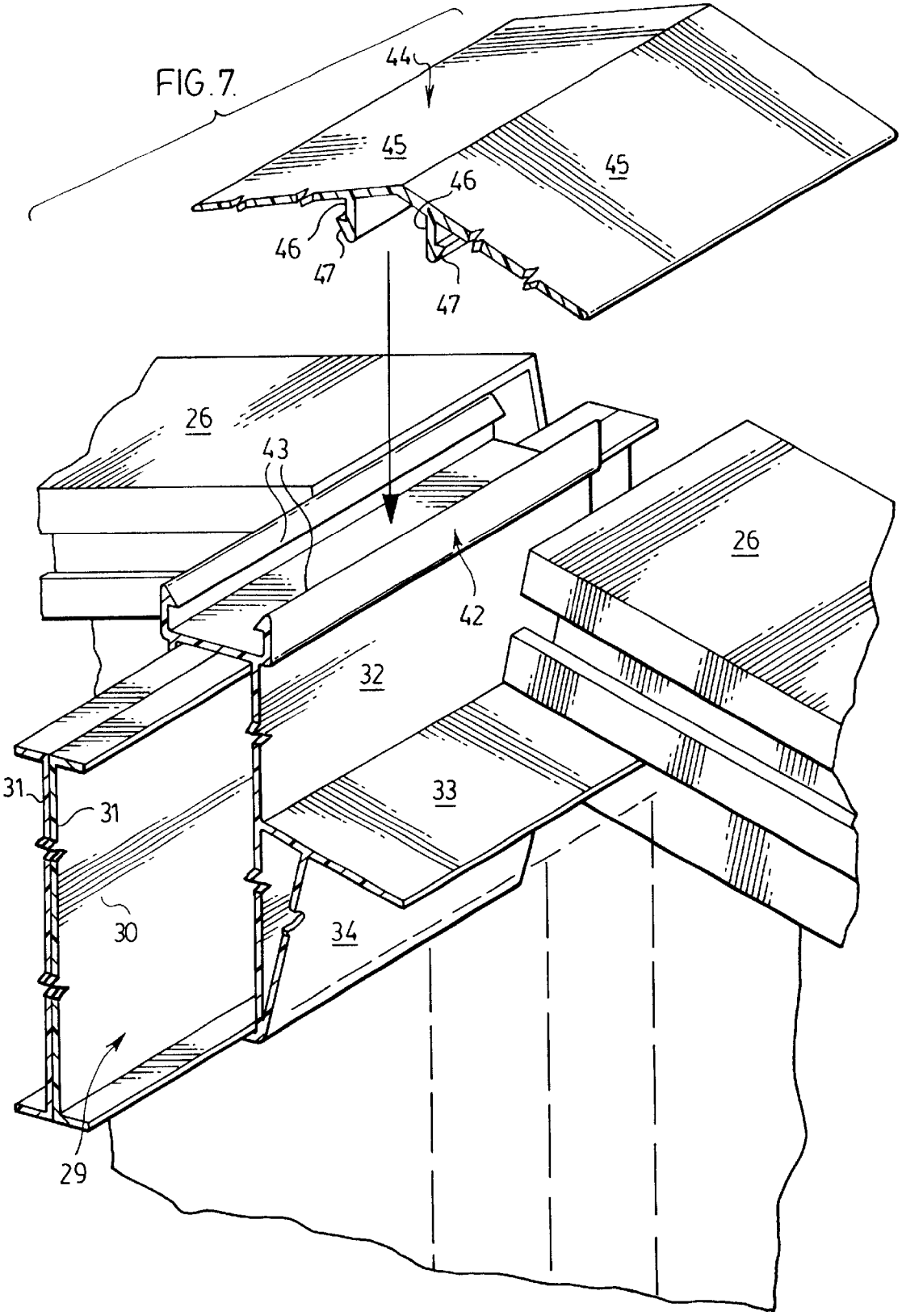
FIG. 7 is a broken away perspective view showing how the ridge beam assembly supports the upper end of the roof panels and showing the ridge flashing ready to be assembled with the ridge beam assembly.
Figure 8:
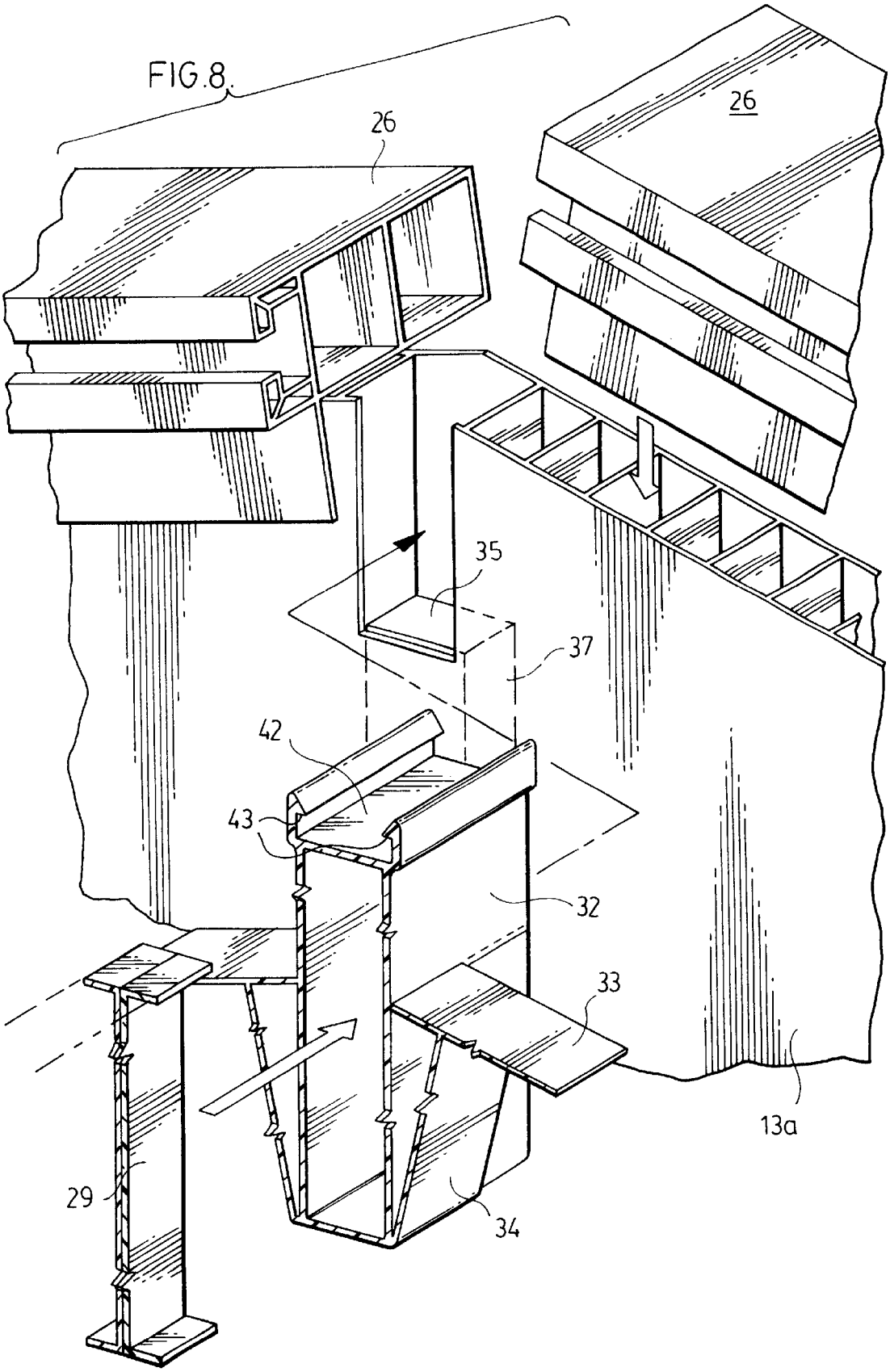
FIG. 8 is a perspective exploded view showing how the ridge beam assembly is assembled with the beam being mounted to be supported in a notch in the rear wall of the shed.

The upper end of the roof panels are supported on a ridge beam assembly shown in FIGS. 7 and 8 and generally designated at 29. This assembly comprises a beam 30 in the form of back to back panels 31 preferably of steel to provide a narrow flanged I-beam.

Sleeved on this beam 30 is a plastic sleeve 32 having an outwardly and downwardly sloping support shelve 33 at each side thereof for supporting the upper ends of the roof panels and the end caps 25.

Each of the shelves 33 is braced by a web 34 extending diagonally outwardly from the bottom of the sleeve 32 to the underside of the shelve 33.

The sleeve 32 is preferably an extrusion of PVC containing suitable stiffening agents and has its exposed surface coated with a cap stock.

The beam 30 is adapted to span between the front and rear walls 4 and 4*a* of the shed and to be supported on the top thereof.

Figure 6:
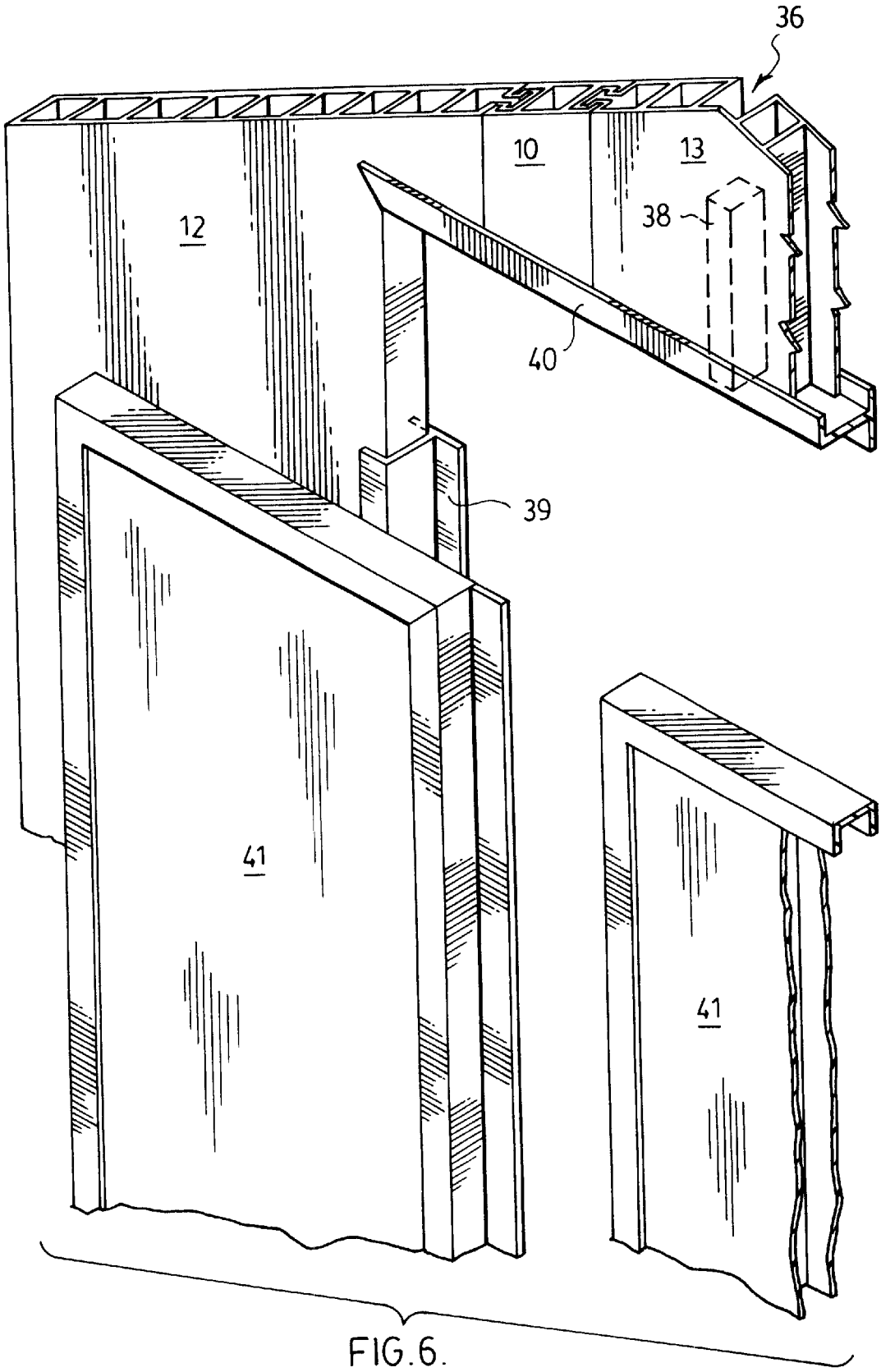
FIG. 6 is a broken away perspective view illustrating how the front end wall is assembled and showing the framing for the door opening with the doors to be hinged therein.

As shown in FIG. 8, the rear wall central panel 13*a* had its innerface notched to provide a seat 35 for one end of the beam 30. As shown in FIG. 6, the front wall central panel 13 is similarly notched to provide a seat 36 for the beam 30 at the front of the shed.

To provide reinforcing support for the beam, the internal compartment of the rear wall panel 13*a* beneath the seat 35 has a wood post 37 sleeved down into the compartment to reach from the bottom of the seat 35 to the shed base 2.

Similarly, at the front of the shed, a short wood insert is sleeved down into the respective compartment of the central panel 13 below the seat 36.

It will be understood that the door opening 5 will be finished by door framing members comprising vertical members 39 and a horizontal top member 40 spanning between the vertical members 39 and the insert 38 extends down to rest on the top door frame member 40.

It will be understood that the doors 41 will be suitably hinged in the framed door opening 5.

Figure 4:
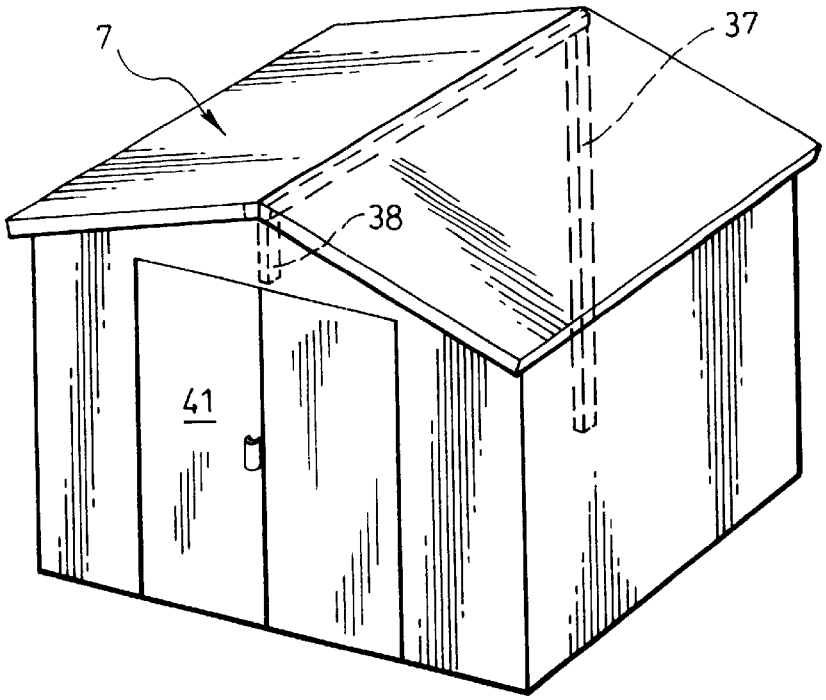
FIG. 4 is a more or less diagrammatical view of the shed of FIG. 1 diagrammatically illustrating the support of the ridge beam of the ridge beam assembly.

The simplified diagram FIG. 4 illustrates the position of the beam supporting inserts 37 and 38.

Returning to FIGS. 7 and 8, it will be seen that the sleeve 32 is provided with an integral upwardly facing channel 42 with the upper edges of the channel walls being formed with inturned latching or locking hooks 40.

To cover the ridge of the shed, a ridge cover or flashing 44 of PVC is provided having downwardly sloping wings 45 beneath which are spaced legs 46 terminating in latches or hooks 47 adapted to interlock with the latch hooks 43 of the channel 42 to seal the roof. The upper surface of these wings is provided with a protective cap stock.

Figure 5:
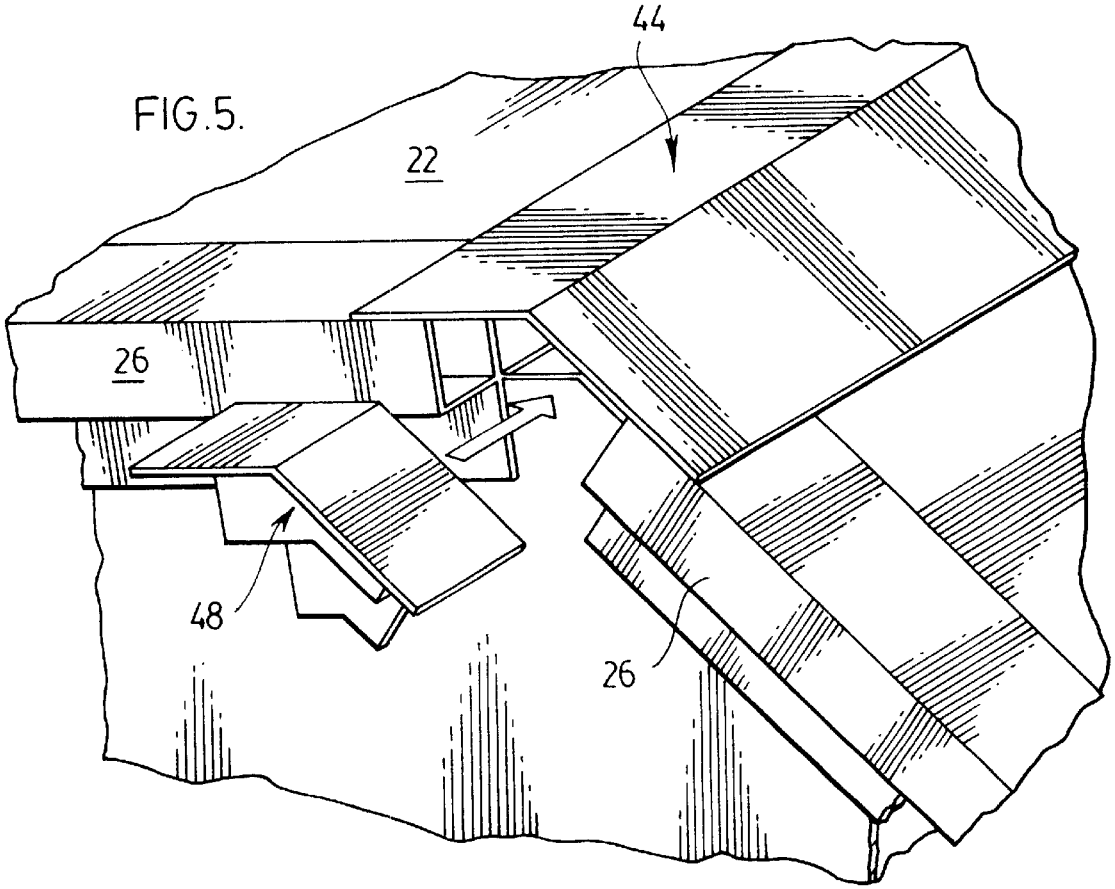
FIG. 5 is a broken away perspective view illustrating the manner of closing the ends of the shed ridge.

To close the space at the ends of the ridge flashing 44 between the spaced ends of the end wall caps 26, an end cap member 48 is provided as illustrated in FIG. 5.

Figure 2:
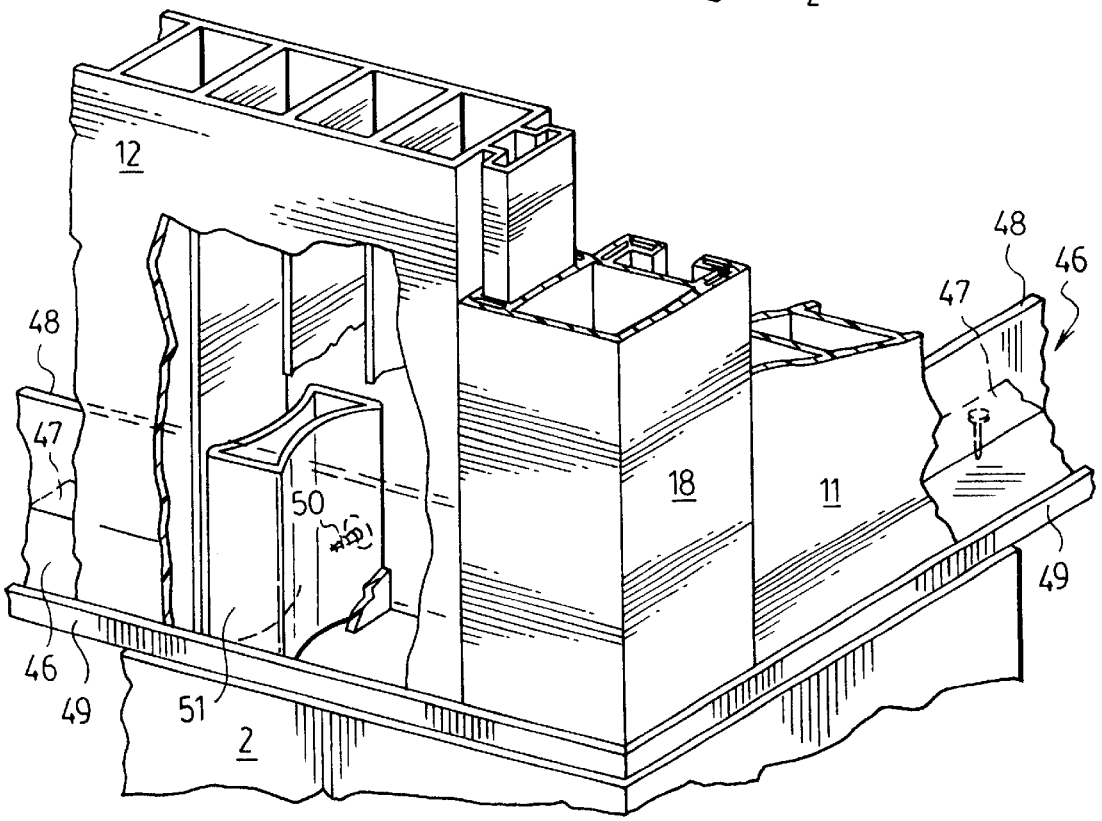
FIG. 2 is a broken away perspective view of a lower corner of the shed of FIG. 1 showing how the side and end panels are interlocked together and secured to the base channel and showing details of the connected panels and the corner connector.

As illustrated in FIG. 2, the shed base 2 has mounted thereon at the edges thereof channel members 46 formed with a laterally extending nailing fin 47 and formed to present an inner wall 48 substantially higher than the outer wall 49 so that water accumulating in the channel members 46 will spill outwardly and not into the shed.

As illustrated in FIG. 2, the walls of the shed fit down into the channels 46 and are secured thereto by suitable screws or fasteners 50.

To provide added holding power for the screws being screwed to the walls of the wall extrusions, a flexible plastic insert is introduced into the appropriate wall panel compartment in position to receive a screw. It will be understood that the insert 51 will be distorted for introduction into the extruded panel where on recovery it will be tightly held in position as required.

It will be understood that all of the various components after assembly can be permanently fixed by screwing the components together with the components being provided with in place inserts 51 at the appropriate positions to provide the holding power for the screws.

An additional feature of the present invention is the provision of a packing case generally designated at 52 into which the components of the shed are packed, the packing case being constructed so that on being dismantled it serves as the base 2 of the shed. Thus the case is a component of the shed.

More particularly, the case comprises top and bottom platforms 53 held in spaced relation by bracing 54. The ends of the packing case are closed by panel members 55 which become the only parts of the case which are discarded upon dismantlement.

Each of the platforms 53 comprises a sheet of plywood, fiber board or other suitable similar material into which nails or screws can be driven mounted on a border frame 56 formed of two by fours or the equivalent.

Each of the platforms 53 is equal to one half of the area required for the shed base. While this area may be slightly larger that the required base area, it must not be smaller.

FIG. 13 shows the platforms 53 assembled together following the dismantlement of the case with the channels 46, which preferably are of aluminum, partially in place around the border of the now formed base 2.

While the preferred embodiments of the invention have been particularly described, variations therein may be made without departing from the scope of the appended claims.

The Embodiments of the Invention in which an exclusive property or privilege is claimed are defined as follows:

1. A rectangular shed formed from prefabricated hollow plastic members comprising side walls, end walls and a roof, said members of said end walls having upper portions which slope upwardly to a central ridge, and said roof sloping upwardly toward said central ridge, said roof members having lower ends supported by said side walls and having upper ends supported by a ridge beam assembly including a metal beam spanning between and supported by said end walls, a plastic sleeve sleeved on and supported by said metal beam and encasing said metal beam between said end walls, said sleeve having spaced depending sides, each of said depending sides of said sleeve having a longitudinal downwardly sloping roof support shelf spaced entirely below a top of said sleeve and metal beam for supporting said upper ends of said hollow roof members, said ridge beam assembly further including a ridge flashing overlying said sleeve and the upper ends of said roof members, wherein said roof supporting shelves and said plastic sleeve comprise a continuous, unitary, homogeneous element.

2. A shed as claimed in claim 1 in which said ridge beam assembly plastic sleeve is formed with an upwardly facing channel and presenting spaced upwardly extending side walls provided at their upper ends with latch formations for detachably securing said ridge flashing to said sleeve.

3. A shed as claimed in claim 2 in which said ridge flashing is provided with downwardly extending legs having latch formations on the lower ends thereof to interlockingly engage with said channel wall latch formations.

4. A shed as claimed in claim 1 in which said hollow wall and roof members comprise elongated hollow rectangular panel extrusions having multiple internal longitudinal compartments and elongated hollow T-shaped connectors.

5. A shed as claimed in claim 4 in which said panel extrusions comprises thermoplastic extrusions having a coextruded protective skin on exterior surfaces thereof.

6. A shed as claimed in claim 4 in which said panel extrusions each comprise a coextrusion of a reinforced PVC and a protective skin comprising a cap stock containing weathering agents.

7. A shed as claimed in claim 4 in which two of said panel extrusions are connected by an extruded thermoplastic elongated hollow rectangular connector having two pairs of spaced hollow projecting inturned locking fingers adapted to interlockingly engage the hollow T-shaped connectors of said two panel extrusions.

8. A shed as claimed in claim 7 in which the connector is a coextrusion of a reinforced PVC and a protective skin.

9. A shed as claimed in claim 4 in which said shed is mounted on a rectangular platform having a border of metal channels in which lower ends of said panel extrusions forming said walls are received and are secured thereto.

10. A shed as claimed in claim 9 in which said channels are aluminum and have a nailing fins for securing said channels to said platform and an inner wall higher than an outer wall.

11. A ridge beam assembly for a prefabricated shed, said ridge beam assembly comprising an elongated metal ridge beam to be supported at its ends, an elongated plastic member having a rectangular plastic sleeve portion sleeved on and supported by said metal beam while encasing said metal beam the length thereof to adjacent said metal beam ends, said sleeve portion having two sides each including a roof load supporting downwardly sloping shelf spaced entirely below a top of said sleeve portion and metal beam, wherein said roof supporting shelves and said plastic sleeve portion comprise a continuous, unitary, homogeneous element.

12. A ridge beam assembly as claimed in claim 11 in which said rectangular plastic sleeve portion is formed with an upwardly facing channel having spaced channel walls terminating in end latches for releasably attaching a ridge beam flashing.

13. A ridge beam assembly as claimed in claim 11 or 12 in which said plastic member is extruded from reinforced PVC and has a protective skin on surfaces thereof which are exposed when in use.

14. A ridge beam assembly as claimed in claim 11 in which said metal beam when encased in said rectangular sleeve portion spans between a top and a bottom of said sleeve portion.

* * * * *